US009334623B2

(12) United States Patent
Billaud

(10) Patent No.: US 9,334,623 B2
(45) Date of Patent: May 10, 2016

(54) IMPLEMENT COUPLING SYSTEM FOR A POWER MACHINE

(75) Inventor: Gaetan Billaud, Treillieres (FR)

(73) Assignee: Clark Equipment Company, West Fargo, ND (US)

( * ) Notice: Subject to any disclaimer, the term of this patent is extended or adjusted under 35 U.S.C. 154(b) by 66 days.

(21) Appl. No.: 14/004,232

(22) PCT Filed: Mar. 9, 2012

(86) PCT No.: PCT/US2012/028465

§ 371 (c)(1),
(2), (4) Date: Sep. 10, 2013

(87) PCT Pub. No.: WO2012/122469

PCT Pub. Date: Sep. 13, 2012

(65) Prior Publication Data

US 2013/0343813 A1 Dec. 26, 2013

Related U.S. Application Data

(60) Provisional application No. 61/451,405, filed on Mar. 10, 2011.

(51) Int. Cl.

| | |
|---|---|
| ***E02F 3/36*** | (2006.01) |
| ***B66F 9/065*** | (2006.01) |
| ***E02F 9/22*** | (2006.01) |
| ***B66F 9/12*** | (2006.01) |
| ***B66F 11/04*** | (2006.01) |

(52) U.S. Cl.

CPC . *E02F 3/36* (2013.01); *B66F 9/065* (2013.01); *B66F 9/12* (2013.01); *B66F 11/04* (2013.01); *E02F 3/3636* (2013.01); *E02F 3/3663* (2013.01); *E02F 9/22* (2013.01); *E02F 9/226* (2013.01); *Y10T 403/70* (2015.01)

(58) Field of Classification Search

CPC ..... E02F 3/365; E02F 3/3622; E02F 3/3627; E02F 3/3636; E02F 3/3663; E02F 3/3681; E02F 3/36; E02F 9/226; E02F 9/22; B66F 9/065; B66F 9/12; B66F 11/04

USPC ..... 37/466, 468, 403; 172/272, 273; 414/722–724; 403/322.1

See application file for complete search history.

(56) References Cited

U.S. PATENT DOCUMENTS

| | | | | |
|---|---|---|---|---|
| 5,125,788 | A | 6/1992 | Stenger | |
| 5,147,173 | A | 9/1992 | Fauber et al. | |
| 6,332,747 | B1 * | 12/2001 | Lee | 414/723 |
| 7,690,880 | B2 * | 4/2010 | Honeyman et al. | 414/723 |

FOREIGN PATENT DOCUMENTS

| | | |
|---|---|---|
| AU | 2009201972 | 11/2009 |
| CN | 101492923 A | 7/2009 |
| EP | 0943738 | 9/1999 |

OTHER PUBLICATIONS

Search Report and Written Opinion dated May 30, 2012 for International Patent Application No. PCT/US2012/028465 filed Mar. 9, 2012, 12 pages.

Chinese Office Action dated Feb. 11, 2015 with English translation for corresponding Chinese Application No. 201280012323.1, 9 pages.

* cited by examiner

*Primary Examiner* — Robert Pezzuto

(74) *Attorney, Agent, or Firm* — John D. Veldhuis-Kroeze; Westman, Champlin & Koehler, P.A.

(57) ABSTRACT

The present disclosure relates to an implement locking system for locking an implement to an implement carrier of a power machine. The implement locking system includes a locking mechanism having a locking pin with an extended position for locking the implement to the implement carrier and a retracted position for mounting or removing the implement from the implement carrier. A user input provides a signal indicative of an operator intent to move the locking pin to the retracted position. A locking actuation valve controls the locking mechanism to automatically and continuously extend the locking pin in the absence of the signal being indicative of the intent to move the locking pin to the retracted position. The locking actuation valve moves the locking pin to the retracted position only for the time corresponding to the signal being indicative of moving to the retracted position.

15 Claims, 6 Drawing Sheets

IMPLEMENT COUPLING SYSTEM FOR A POWER MACHINE

CROSS-REFERENCE TO RELATED APPLICATION

This Application is a Section 371 National Stage Application of International Application No. PCT/US2012/028465, internationally filed on Mar. 9, 2012, and published as WO 2012/122469 on Sep. 13, 2012, in English; which claims priority to U.S. Provisional Patent Application No. 61/451,405, filed Mar. 10, 2011, the contents of which are hereby incorporated by reference in their entireties.

BACKGROUND

Power machines include various work vehicles such as telehandlers, skid steer loaders, tracked loaders, excavators, and utility vehicles. Telehandlers and other power machines typically utilize a hydraulic system including one or more hydraulic pumps that provide pressurized hydraulic fluid to accomplish a number of tasks, including to power travel motors in a drive system; to raise, lower, extend, and retract a boom or a lift arm; to rotate implements that may be coupled to the power machine with respect to the lift arm or boom thereof; and to provide hydraulic fluid to motors and actuators on certain implements to perform functions related to the implement, and the like. Implements provide much versatility in power machine use. The ability to change implements to perform various work functions enhances that versatility. Therefore, implements are generally removably mounted on an arm, boom, or other structural member of the power machine.

Implement mounting devices or carriers are carried on an arm and are used for quickly attaching and detaching various accessories or tools, such as buckets, pallet forks, augers, etc. without the use of any tools. Implement carriers have been utilized quite extensively for the ease of changing between implements on a power machines. Typically, implements that are capable of being coupled with an implement carrier of a particular power machine have a structure that is complementary to the implement carrier. More particularly, in many instances, implements have a mounting structure with apertures formed there through capable of accepting pins that extend from the implement carrier to secure the implement to the implement carrier. When attaching an implement to a power machine, care must be taken to ensure that the implement is properly secured to the implement carrier, that is, that the implement is properly seated on the implement carrier and that the pins are extending through the complementary apertures on the implement.

Some power machines have powered implement locking mechanisms that utilize a power source such as pressurized hydraulic fluid to extend and retract pins on the implement carrier to secure an implement to or release an implement from an implement carrier. Some powered implement locking mechanisms utilize a diverter valve that diverts flow of hydraulic fluid from a tilt cylinder that rotates the implement carrier with respect to a lift arm or boom to cause locking mechanism pins to extend or retract to secure or release the implement related to the implement carrier. Such implement locking mechanisms require the tilt cylinder to be actuated to carry out the locking function. For example, with a bucket type of implement, these systems would require that the bucket be rolled back, that is, the tilt cylinder needs to be completely retracted, to provide the hydraulic flow necessary to extend the locking pins. This locking technique can be challenging if the bucket or other implement isn't seated properly on the implement carrier. Not allowing the implement to be removed while in a variety of different positions can be disadvantageous as well.

Other powered implement locking mechanisms are not dependent on the position of the implement or actuation of a tilt cylinder to engage and disengage. For example, other attachment mechanisms allow locking pins to be engaged in response to a user input from the power machine operator. However, this requires that the operator remember to engage the locking mechanism, and take affirmative action to do so.

The discussion above is merely provided for general background information and is not intended to be used as an aid in determining the scope of the claimed subject matter.

SUMMARY

Disclosed is an implement locking system for locking an implement to an implement carrier of a power machine. The implement locking system includes a locking mechanism having at least one locking pin that is positionable to releasably lock the implement to the implement carrier. The at least one locking pin has an extended position that locks the implement to the implement carrier when the implement is mounted on the implement carrier and a retracted position in which the implement can be mounted on or removed from the implement carrier. A user input is configured to provide a signal, when actuated by an operator, indicative of an affirmative operator intent to move the at least one locking pin to the retracted position. A locking actuation valve is operably coupled to the user input to receive the signal and coupled to the locking mechanism to control the locking mechanism. The locking actuation valve is configured to control the locking mechanism to automatically and continuously extend the at least one locking pin in the absence of the signal being indicative of the affirmative operator intent to move the at least one locking pin to the retracted position. The locking actuation valve is configured to control the locking mechanism to move the at least one locking pin to the retracted position only for a period of time corresponding to the signal being indicative of the affirmative operator intent to move the at least one locking pin to the retracted position.

This Summary is provided to introduce a selection of concepts in a simplified form that are further described below in the Detailed Description.

DETAILED DESCRIPTION OF ILLUSTRATIVE EMBODIMENTS

Before any embodiments of the invention are explained in detail, it is to be understood that the concepts disclosed herein are not limited in their application to the details of construction and the arrangement of components set forth in the following description or illustrated in the following drawings.

The concepts illustrated in these embodiments are capable of being practiced or of being carried out in various ways. The phraseology and terminology used herein is for the purpose of description and should not be regarded as limiting. Words such as "including," "comprising," and "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Figure 1:
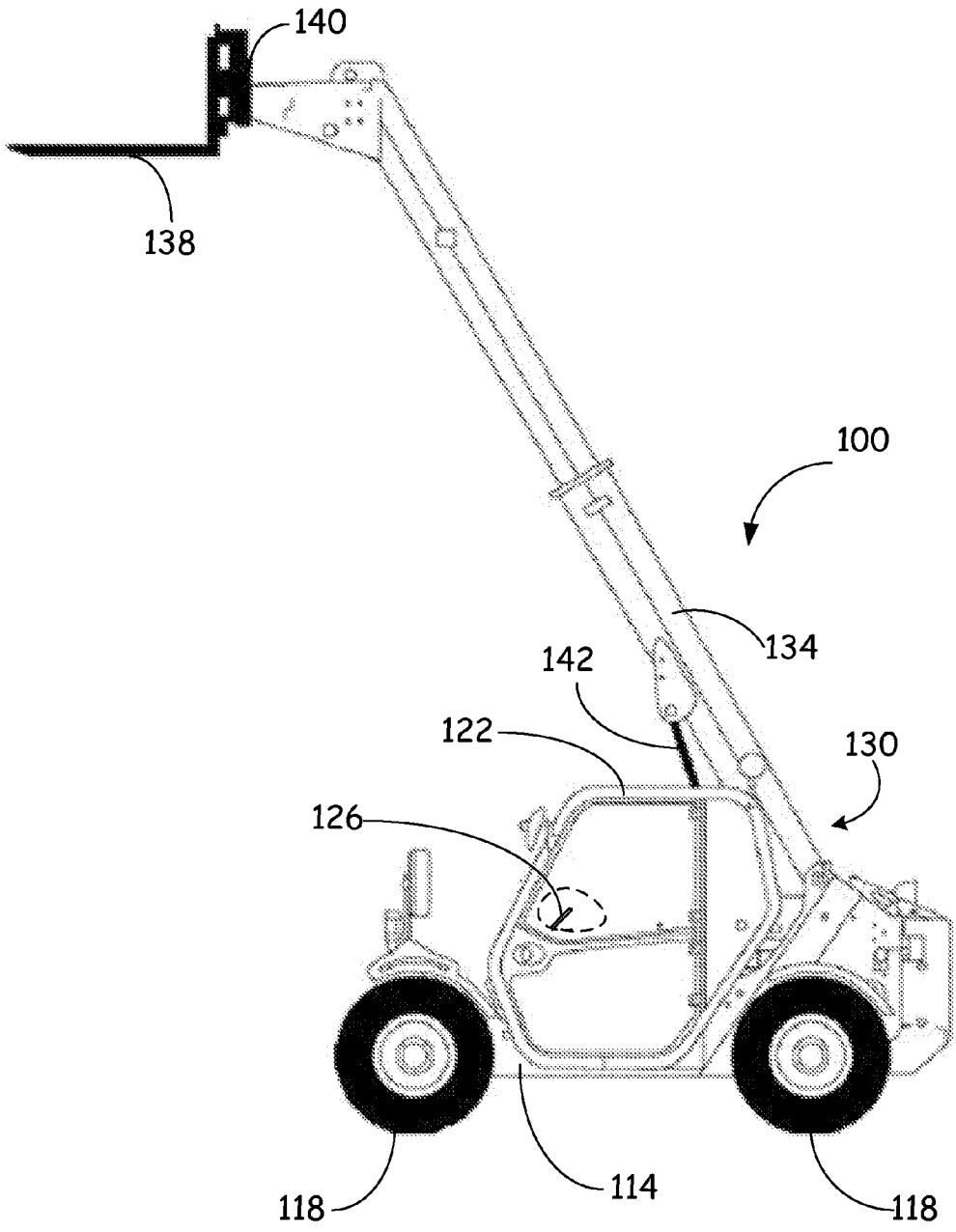
FIG. 1 is a left side view of a power machine according to a disclosed embodiment.

A power machine 100 in the form of a telehander is shown in FIG. 1 and is provided as an example of a type of power machine in which disclosed embodiments can be utilized. Other types of power machines on which the disclosed embodiment can be practiced includes various types of loaders, excavators, utility vehicles, and the like. Power machine 100 includes a frame 114 supported for movement over the ground by front and rear pairs of wheels 118. An operator cab 122 is mounted to the frame 114 and includes operator controls 126 for controlling operation of the power machine 100. Operator controls 126 can include any of a variety of different operator control device types, and the illustrated operator controls 126 generally represent the various operator control types. An engine is mounted to the frame 114 and provides a power source for moving the wheels 118 and also for other systems. The engine, represented generally at reference number 130, is typically positioned on a right side of power machine 100 next to cab 122, and therefore is not visible in this figure. The engine 130 can be an internal combustion engine, a hydraulic engine, etc. A boom 134, which in this embodiment is a telescopic boom, but in other embodiments can be any type of lift or of work arm are pivotally mounted to the frame 114 and include an implement 138 at a distal end thereof attached to the boom or other components of the work machine by an implement carrier 140. The implement 138 can be any of a wide variety of different types of implements, for example including a bucket, pallet forks, etc. One or more hydraulic cylinders 142 are coupled between the frame 114 and the boom 134 for raising and lowering the boom 134. One or more other hydraulic cylinders can also be included for performing tilt, boom extension, or other functions. Power machine 100 includes a hydraulic pump system and an implement locking system such as the one illustrated in example embodiments shown in FIGS. 2-5.

Figure 2:
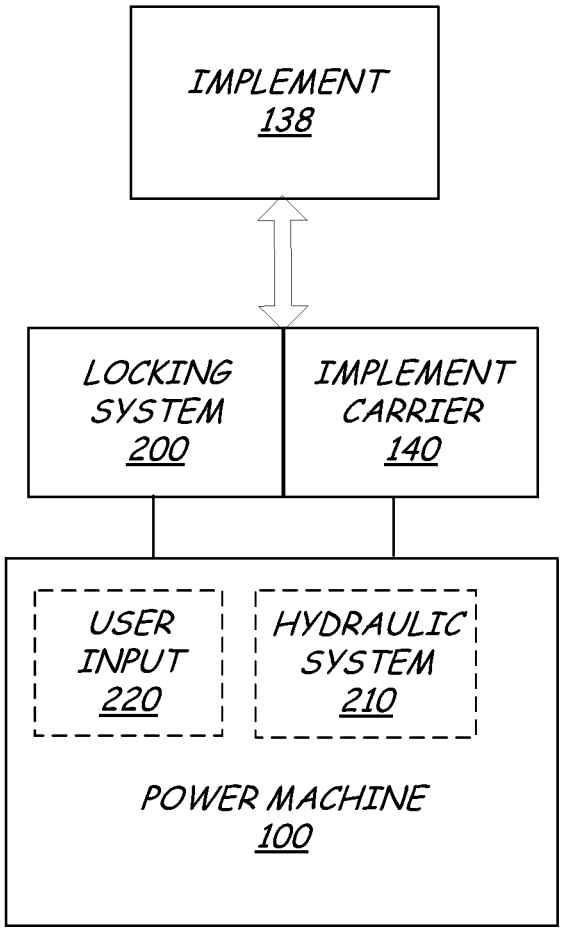
FIG. 2 is a block diagram illustrating a locking system in relation to a power machine, an implement carrier and an implement.

Referring now to FIG. 2, shown is a block diagram illustrating functional relationships between a power machine 100, an implement 138, an implement carrier 140, and a locking system 200 in an exemplary embodiment. An implement 138 is physically and functionally connected to power machine 100 using an implement carrier 140. Implement carrier 140, which is, in an example embodiment, a type of quick mechanical coupler, is typically considered to be a component of power machine 100. However, implement carrier 140 can also be considered to be a component of implement 138 or to be comprised of components of each of power machine 100 and implement 138.

A hydraulic system 210 of power machine 100 includes one or more hydraulic pumps that supply hydraulic fluid under pressure to the hydraulic valves, motors and/or other hydraulic components of the hydraulic system and of the power machine. Hydraulic system 210 also supplies hydraulic fluid under pressure to the hydraulic components of implement 138, implement carrier 140, and locking system 200. Locking system 200 can be considered to be part of power machine 100 (including part of hydraulic system 210), part of implement carrier 140, part of implement 138, or a combination thereof.

In operation, with the engine of power machine 100 running and hydraulic pumps being powered, locking system 200 provides continuous flow of hydraulic fluid to extend one or more locking pins that secure implement 138 to implement carrier 140 and/or other structural components of power machine 100. No affirmative action is required of an operator of power machine 100 to cause the locking pins to be extended. Further, when the engine of power machine 100 is turned off, or when the flow of hydraulic fluid in locking system 100 is interrupted for other reasons, the locking pins are maintained in their extended position by a check valve or other hydraulic components which maintain sufficient pressure to prevent the unintentional retraction of the locking pins.

When an operator wishes to retract the locking pins of locking system 200 to prepare the implement carrier 140 to be able to engage, and eventually to secure an implement thereto, or alternatively to remove an implement from implement carrier 140, a user input 220 is used to control the locking system to temporarily retract the locking pins. The user input 220 can be a push button, a toggle switch, a soft key on a touch screen display device, or other types of user input devices that provide signals to locking system 200 to retract the locking pins. After the operator is done actuating user input 220, whether immediately or after a predetermined delay time, locking system 200 again automatically extends the locking pins without affirmative action required by the operator. Unlike conventional systems in which the operator must take affirmative action such as causing a tilt cylinder to completely retract to roll the implement back or actuating a user input to affirmatively command the locking system to extend the locking pins, in disclosed embodiments, the locking system automatically extends the locking pins in the absence of a command from the operator to retract the pins.

Figure 3:
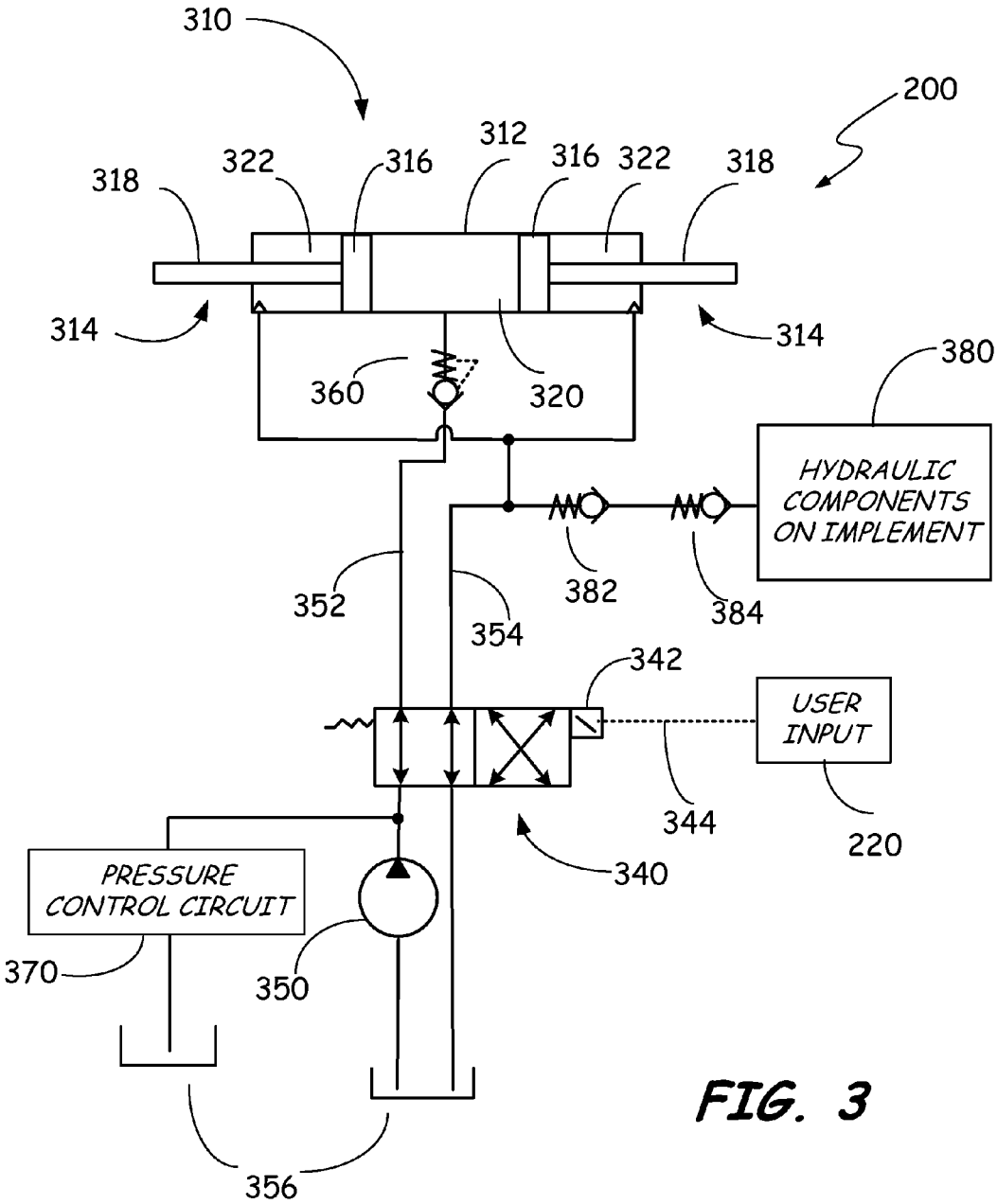
FIGS. 3-5 are schematic illustrations of an implement locking mechanism or system according to an example embodiment.

Referring now to FIG. 3, shown is a schematic illustration of locking system 200 in accordance with an exemplary embodiment. Locking system 200 includes a locking cylinder 310 having a cylinder body 312 and a pair of rod assemblies 314. Each of rod assemblies 314 includes a piston 316 and a rod 318, with rods 318 forming first and second extendable and retractable locking pins. Alternatively, pins suitable for use to engage and secure implements can be operably coupled to the rods 318. Within cylinder body 312, a base end volume 320 is formed between the pistons 316, and rod end volumes 322 are formed at the rod ends of the cylinder body. While in exemplary embodiments locking cylinder 310 is a single two-way cylinder, in other embodiments separate one-way cylinders could be used in place of the two-way cylinder illustrated in FIG. 3. Other arrangements of locking cylinders are contemplated. For example, in one arrangement, a pin is attached to the housing on the base side of a cylinder, with the rod end of the cylinder fixed. When the cylinder is extended, the pin on the base end side of the housing would be available to engage and secure an implement to the implement carrier. In yet another example embodiment, a pin is attached to the rod and a second pin is attached to the base end of the housing of a locking cylinder. Such a locking cylinder would be configured so that extension of the cylinder would cause each of the pins to extend so that they would be available to engage and secure an implement to the implement carrier. It should also be appreciated that while the embodiments above generally disclose two pins that are extended to secure an implement, any number of pins can be used as is advantageous to secure the implement. Further, while the embodiments disclose the employment of generally linear actuators, other types of actuators, such as rotational actuators and other types of latching mechanisms besides pins can be used in alternate embodiments.

Locking system 200 also includes a locking actuation valve 340. Locking actuation valve 340 includes a solenoid or other valve actuator 342, which is operably coupled to a user input 220 to provide control of the position of locking actuation valve 340. The operable coupling of valve actuator 342 to user input 220 illustrated as connection 344 is of any desired configuration, including a hard wired connection, a wireless connection, a connection through one or more controllers, a connection through a controller area network (CAN), etc. User input 220 provides a signal that, either directly or indirectly, through wired, wireless or network connections, causes valve actuator 342 to control the position of locking actuation valve 340. Locking actuation valve 340 is normally biased into the position shown in FIGS. 3 and 4. However, under control from user input 220 and valve actuator 342, locking actuation valve 340 is caused to change to the position shown in FIG. 5 as is discussed below in greater detail.

Locking system 200 also includes, in the example embodiment, first and second hydraulic hoses or lines 352 and 354 which couple locking actuation valve 340 to locking cylinder 310. First line 352 couples locking actuation valve 340 to base end volume 320 through a pilot operated check valve 360. Second line 354 couples the locking actuation valve 340 to the rod end volumes 322 of the locking cylinder 310. Also shown in FIG. 3 is a hydraulic pump 350, which pumps hydraulic fluid from tank 356 to locking actuation valve 340, and which has an pressure control circuit 370 that maintains a constant pressure to the locking cylinder 310 at a pressure level to provide extension and retraction of the pins while preventing damage from excessive pressure to locking cylinder 310, implement 138, or other components. In one embodiment, the pressure control circuit 370 is a relief valve. Alternatively, the pressure control circuit 370 includes a flow divider or a priority flow valve, which channels flow to other hydraulic circuits on the power machine 100, while also providing a consistent pressure to maintain the locking cylinder 310 in an extended or retracted position as required. In addition, the pressure control circuit 370 ensures that sufficient flow is available to the locking cylinder 310 when it is extending or retracting. In yet another embodiment, the hydraulic pump 350 can be a pilot operated variable displacement pump, which provides pressure and flow as needed. While hydraulic pump 350 will typically be part of the hydraulic system 210 of power machine 100, hydraulic pump 350 can be considered part of locking system 200 as well.

Figure 4:
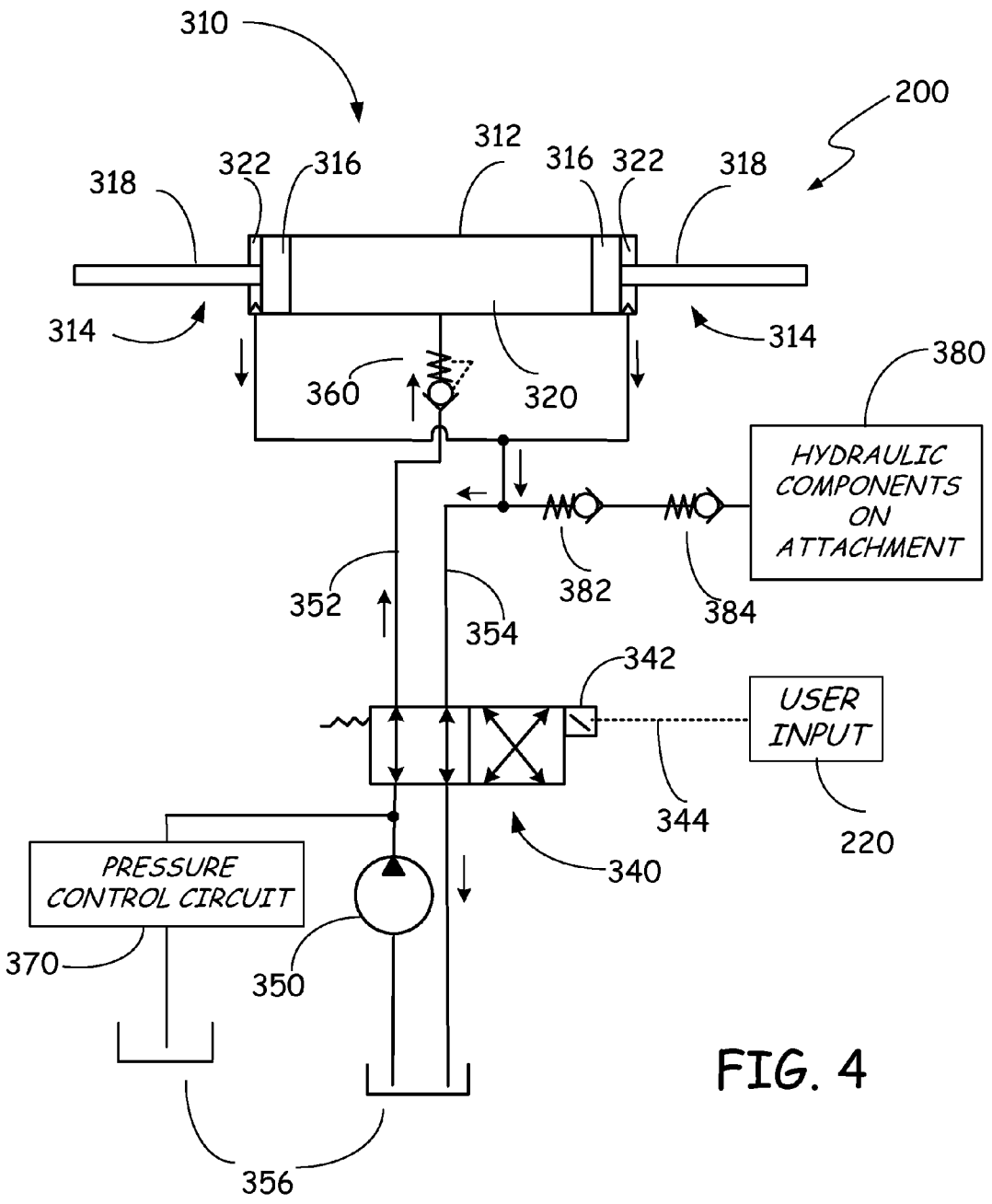

In operation, under normal conditions in which an operator has not affirmatively provided a command to retract rods or pins 318, locking actuation valve 340 remains in its normal bias position and couples the flow of hydraulic fluid from pump 350 to first line 352 as shown in FIG. 3. The pressurized flow of fluid opens pilot operated check valve 360 and flows into base end volume 320 of cylinder body 312, causing pins 318 to extend outside of the cylinder body. As the pins 318 extend, hydraulic fluid is forced out of rod end volumes 322 and returns to tank 356 through second line 354 and locking actuation valve 340. Thus, without any affirmative action required by the operator, system 200 continuously locks the implement 138 to the power machine by maintaining the flow of pressurized fluid to base end volume 320 of cylinder body 312 keeping pins 318 extended. This mode of operation occurs automatically. The direction of flow of hydraulic fluid and the fully extended positions of pins 318 in this normal mode of operation are illustrated in FIG. 4. If the engine of power machine 100 is turned off in this mode, pilot operated check valve 360 prevents the flow of hydraulic fluid out of base end volume 320 of cylinder body 312, and thus the locked position is maintained.

Figure 5:
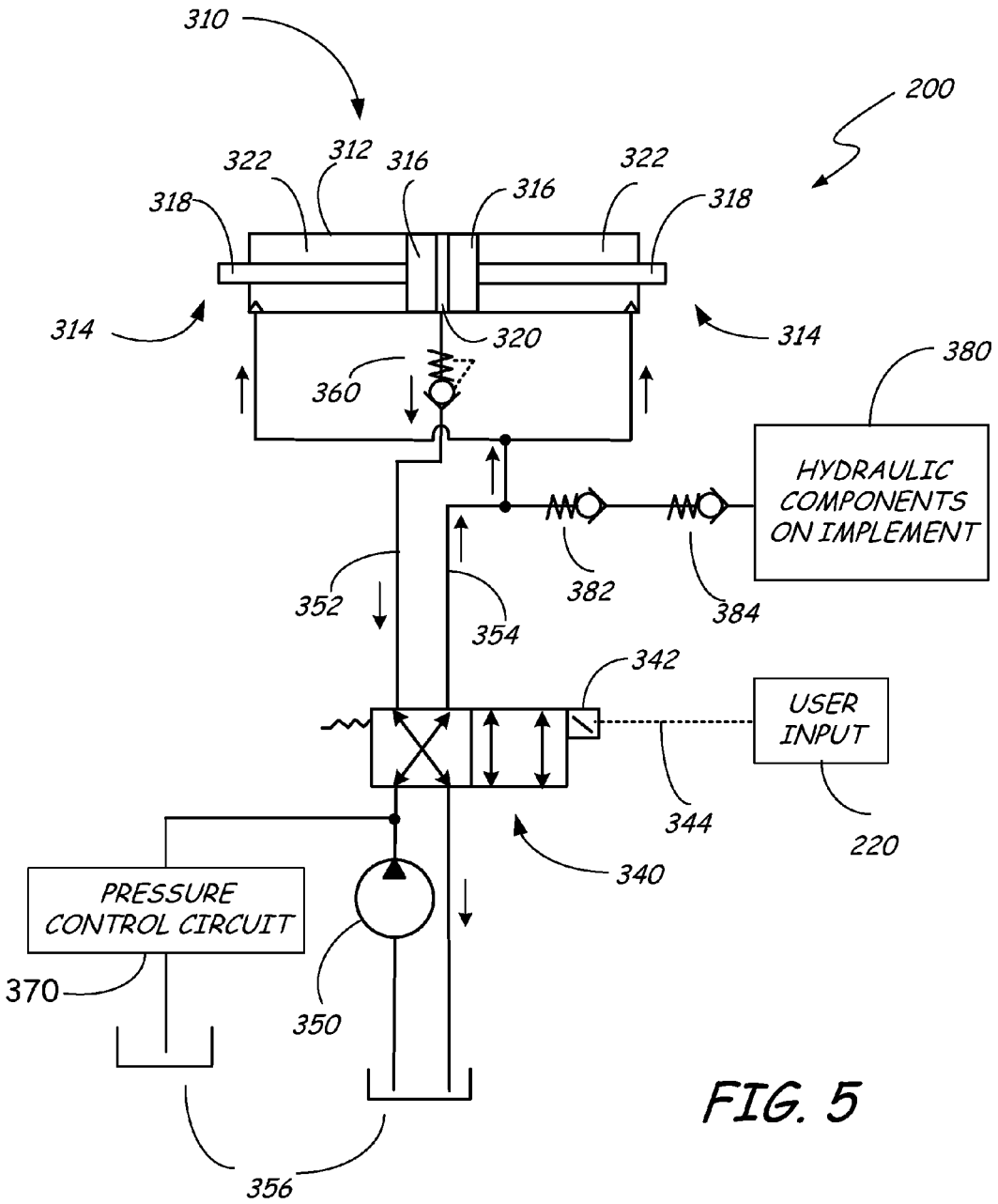

Referring now to FIG. 5, shown is a configuration of system 200 when an operator wishes to retract pins 318 temporarily to couple to an implement or remove an implement. To change from the normally locked configuration, the operator must affirmatively command the system to do so. For example, using user input 220, the operator causes valve actuator 342 to overcome the bias force and move locking actuation valve 340 from its normally biased position. In this position, hydraulic pump 350 is now connected through locking actuation valve 340 to second line 354 and rod end volumes 322, while base end volume 320 is coupled through pilot operated check valve 360 and first line 352 to tank 356. Thus, under operator initiation, locking actuation valve 340 causes hydraulic fluid to be pumped into the rod end volumes 322 of the locking cylinder 310. The pins 318 retract under pressure and hydraulic fluid is forced out of the base end volume 320 toward the pilot operated check valve 360. With sufficient pressure from operation of hydraulic pump 350, the pilot operated check valve 360 opens and connects the base end volume 320 to tank 356 through the locking actuation valve 340. When the operator quits depressing a button or otherwise stops affirmatively signaling that the pins 318 are to be retracted, the locking actuation valve 340 automatically switches back to its normal position and the pins are automatically and continuously extended again.

One advantage provided by locking system 200 is that, if there is a misalignment of the implement 138 and the implement carrier 140 preventing correct locking to occur (e.g., by the pins 318 not being properly aligned with the complementary apertures in the implement), once the pins 318 become properly aligned, system 200 will automatically force the pins 318 out into the locking position without the operator having to actuate a switch or take other affirmative action.

Another feature of an exemplary embodiment allows locking system 200 to be implemented with fewer additional hydraulic hoses or lines. Two hydraulic lines need to be provided to locking cylinder 310 to allow for operation of the cylinder. As discussed above, many implements have hydraulic functions thereon, which require two hydraulic lines for operation. In addition, certain hydraulic components on implements require an additional line, known as a case drain, which provides a drain of hydraulic fluid from a hydraulic device to prevent excessive pressures from damaging the components. As shown, second line 354 also serves as a case drain for hydraulic components 380 on implement 138. Second line 354 is shown as being in communication with hydraulic components 380 on the implement via a case drain check valve 382 and a quick coupler 384, shown as check valve schematically in FIGS. 3-5.

Case drain check valve 382 prevents flow of hydraulic fluid from second line 354 to an implement. Thus, when the operator is affirmatively causing the pins 318 to be retracted, hydraulic flow is provided to the rod end volumes 322, while case drain check valve 382 prevents the hydraulic fluid from flowing to the implement 138. When the pins 318 are extended from a retracted position, hydraulic fluid from the rod end volumes 322 of the locking cylinder 310 flows into the second line 354 until the pins are extended, at which point there is no appreciable oil flowing from rod end volumes 322 into second line 354 and second line 354 provides a case drain for the hydraulic components 380 that are in communication therewith. Thus, system 200 can be implemented with only one additional hydraulic line on the boom. In some exemplary embodiments, locking actuation valve 340 will be located out on the boom.

Figure 6:
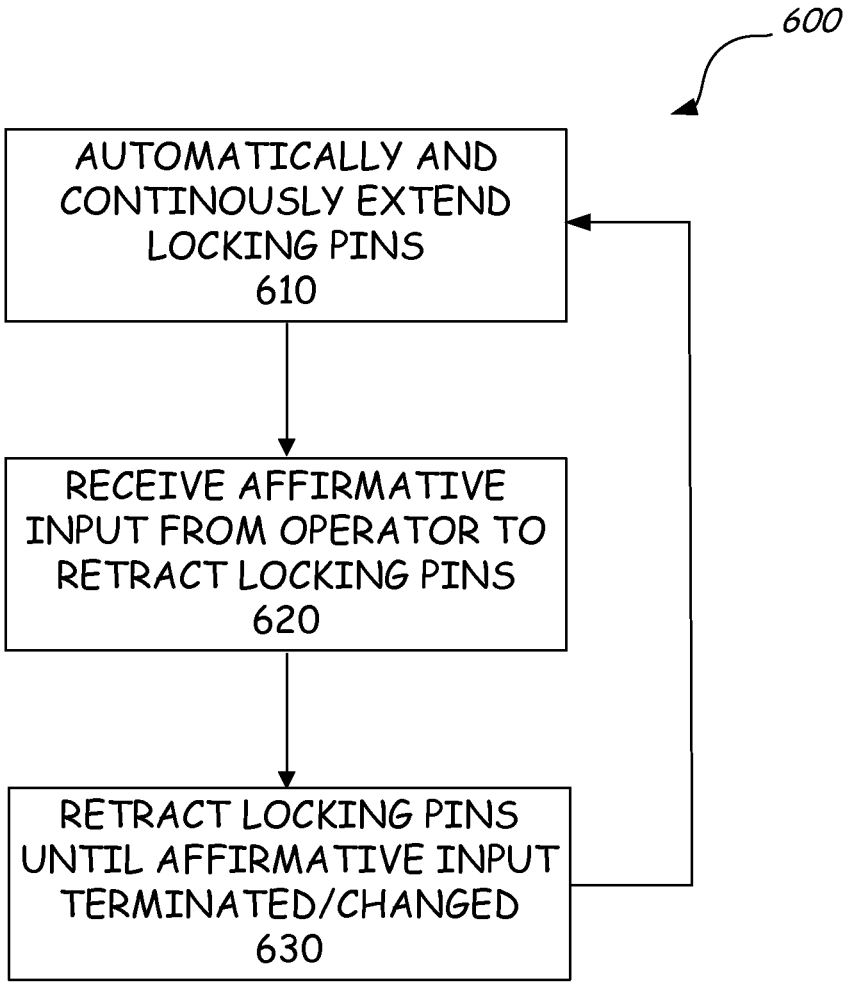
FIG. 6 is a flow diagram illustrating an example of a method of locking an implement to a power machine.

Referring now to FIG. 6, shown is a flow diagram 600 illustrating methods discussed above. As shown at block 610, a method includes the step of automatically and continuously extending locking pins 318 without any affirmative action required from an operator or user. This is accomplished in accordance with the above discussions. Next, as shown at block 620, a signal is received from user input 220 indicative of an operator who has taken an affirmative action to cause the locking pins 318 to be retracted. This is accomplished in accordance with the above discussions, for example receiving a signal corresponding to actuation of a push button, toggle switch or other user input 220. While the affirmative action is taken by the operator, or for a predetermined period of time or during a predetermined action or series of actions, the locking pins 318 are retracted as shown at block 630. During this time, an implement 138 can be released from the implement carrier 140 on the power machine, or an implement 138 can be aligned relative to the power machine 100 for attachment thereto. Then, once the operator has stopped the affirmative action, the method returns to the step of automatically and continuously extending the locking pins 318 shown at block 610.

Although the subject matter has been described in language specific to structural features and/or methodological acts, it is to be understood that the concepts disclosed herein are not limited to the specific embodiments described. Rather, the specific features and acts described above are disclosed as example forms. For example, in various embodiments, different types of power machines can include the disclosed locking systems. Other examples of modifications of the disclosed concepts are also possible, without departing from the scope of the disclosed concepts.

What is claimed is:

1. An implement locking system for locking an implement to an implement carrier of a power machine, comprising:

a locking mechanism having at least one locking pin positionable to releasably lock the implement to the implement carrier, the at least one locking pin having an extended position which locks the implement to the implement carrier when the implement is mounted on the implement carrier, and a retracted position in which the implement can be mounted on or removed from the implement carrier;

an input device configured to provide a signal, when actuated by an operator, indicative of an affirmative operator intent to move the at least one locking pin to the retracted position; and a locking actuation valve operatively coupled to the input device to receive the signal and coupled to the locking mechanism to control the locking mechanism, the locking actuation valve configured to control the locking mechanism to automatically and continuously extend the at least one locking pin in the absence of the signal being indicative of the affirmative operator intent to move the at least one locking pin to the retracted position, the locking actuation valve configured to control the locking mechanism to move the at least one locking pin to the retracted position only for a period of time corresponding to the signal being indicative of the affirmative operator intent to move the at least one locking pin to the retracted position.

2. The implement locking system of claim 1, wherein the locking actuation valve is configured to control the locking mechanism such that, after the period of time corresponding to the signal being indicative of the affirmative operator intent to move the at least one locking pin to the retracted position, the locking mechanism is controlled to automatically and continuously extend the at least one locking pin without affirmative action required by the operator.

3. The implement locking system of claim 2, wherein the input device and locking actuation valve are configured such that the period of time corresponding to the signal being indicative of the affirmative operator intent to move the at least one locking pin to the retracted position is substantially equal to a period of time during which the operator actuates the input device and causes the input device to provide the signal indicative of the affirmative operator intent to move the at least one locking pin to the retracted position.

4. The implement locking system of claim 2, wherein the input device and locking actuation valve are configured such that the period of time corresponding to the signal being indicative of the affirmative operator intent to move the at least one locking pin to the retracted position is substantially equal to a period of time during which the operator actuates the input device and causes the input device to provide the signal indicative of the affirmative operator intent to move the at least one locking pin to the retracted position plus a predetermined delay period of time.

5. The implement locking system of claim 1, and further comprising a hydraulic pump in fluid communication with the locking actuation valve and providing pressurized hydraulic fluid to the locking actuation valve for use in controlling the locking mechanism, wherein the locking mechanism is configured to maintain the at least one locking pin in the extended position even when the hydraulic pump is not providing pressurized fluid to the locking actuation valve.

6. The implement locking system of claim 5, wherein the locking mechanism comprises a cylinder body and first and second rod assemblies, wherein each of the first and second rod assemblies comprise a piston positioned within the cylinder body and a rod, wherein the rods of each of the first and second rod assemblies provide first and second locking pins of the at least one locking pin.

7. The implement locking system of claim 6, wherein within the cylinder body a base end volume is provided between bases of the pistons of the first and second rod assemblies and rod end volumes are provided at rod ends of the cylinder body, wherein the locking actuation valve is coupled to the rod end volumes of the cylinder body through a second hydraulic line and to the base end volume of the cylinder body through a first hydraulic line and a pilot operated check valve, the pilot operated check valve allowing pressurized hydraulic fluid to be directed by the locking actuation valve to extend the first and second locking pins and maintaining the first and second locking pins in the extended position when the hydraulic pump is not providing pressurized fluid to the locking actuation valve.

8. The implement locking system of claim 7, wherein the second hydraulic line is a case drain line for hydraulic components on the implement.

9. The implement locking system of claim 7, wherein in response to the signal from the input device being indicative of the affirmative operator intent to move the at least one locking pin to the retracted position, the locking actuation valve directing pressurized hydraulic fluid to the rod end volumes of the cylinder body through the second hydraulic line, the pilot operated check valve allowing hydraulic fluid under pressure in the base volume to return to a tank to thereby allow the first and second locking pins to move to the retracted position.

10. A power machine comprising:

a frame;

a work arm pivotally coupled to the frame;

an implement carrier coupled to and supported by the work arm, the implement carrier configured to mount an implement to the work arm;

a hydraulic system configured to provide hydraulic fluid under pressure; and a hydraulically powered implement locking system for locking the implement to the implement carrier, the implement locking system comprising:

a locking mechanism having at least one locking pin positionable to releasably lock the implement to the implement carrier, the at least one locking pin having an extended position which locks the implement to the implement carrier when the implement is mounted on the implement carrier, and a retracted position in which the implement can be mounted on or removed from the implement carrier;

an user input configured to provide a signal, when actuated by an operator, indicative of an affirmative operator intent to move the at least one locking pin to the retracted position; and a locking actuation valve operatively coupled to the user input to receive the signal and coupled to the locking mechanism to control the locking mechanism, the locking actuation valve configured to control the locking mechanism to automatically and continuously extend the at least one locking pin in the absence of the signal being indicative of the affirmative operator intent to move the at least one locking pin to the retracted position.

11. The power machine of claim 10, wherein the locking actuation valve is configured to control the locking mechanism such that, after a period of time corresponding to the signal being indicative of the affirmative operator intent to move the at least one locking pin to the retracted position, the locking mechanism is controlled to automatically and continuously extend the at least one locking pin without affirmative action required by the operator.

12. The power machine of claim 10, wherein the locking mechanism is configured to maintain the at least one locking pin in the extended position even when the hydraulic pump is not providing pressurized fluid to the locking actuation valve.

13. The power machine of claim 12, wherein the locking mechanism comprises a cylinder body and first and second rod assemblies, wherein each of the first and second rod assemblies comprise a piston positioned within the cylinder body and a rod, wherein the rods of each of the first and second rod assemblies provide first and second locking pins of the at least one locking pin, the cylinder body providing a base end volume between bases of the first and second pistons and rod end volumes at rod ends of the cylinder body, wherein the locking actuation valve is coupled to the rod end volumes of the cylinder body through a second hydraulic line and to the base end volume of the cylinder body through a first hydraulic line and a pilot operated check valve, the pilot operated check valve allowing pressurized hydraulic fluid to be directed by the locking actuation valve to extend the first and second locking pins and maintaining the first and second locking pins in the extended position when the hydraulic pump is not providing pressurized fluid to the locking actuation valve.

14. The power machine of claim 13, wherein the second hydraulic line is a case drain line for hydraulic components on the implement.

15. The power machine of claim 13, wherein in response to the signal from the user input being indicative of the affirmative operator intent to move the at least one locking pin to the retracted position, the locking actuation valve directing pressurized hydraulic fluid to the rod end volumes of the cylinder body through the second hydraulic line, the pilot operated check valve allowing hydraulic fluid under pressure in the base end volume to return to a tank to thereby allow the first and second locking pins to move to the retracted position.

* * * * *